US012310430B2

(12) United States Patent
Inzer

(10) Patent No.: US 12,310,430 B2
(45) Date of Patent: May 27, 2025

(54) SUPPORT SHIRTS INCLUDING A RESTRICTION PANEL

(71) Applicant: Inzer Advance Designs, Inc., Longview, TX (US)

(72) Inventor: John Inzer, Longview, TX (US)

(73) Assignee: INZER ADVANCE DESIGNS, INC., Longview, TX (US)

( * ) Notice: Subject to any disclaimer, the term of this patent is extended or adjusted under 35 U.S.C. 154(b) by 32 days.

(21) Appl. No.: 17/532,229

(22) Filed: Nov. 22, 2021

(65) Prior Publication Data

US 2022/0160056 A1 May 26, 2022

Related U.S. Application Data

(60) Provisional application No. 63/118,108, filed on Nov. 25, 2020.

(51) Int. Cl.
*A41D 13/00* (2006.01)
*A41B 1/08* (2006.01)

(52) U.S. Cl.
CPC ..... *A41D 13/0015* (2013.01); *A41B 1/08* (2013.01)

(58) Field of Classification Search
CPC .. A41D 13/0015; A41D 13/0017; A41D 1/04; A41D 31/18; A41D 27/10; A41D 27/18; A41D 27/06; A63B 21/4025; A41B 3/10; A41B 3/06
See application file for complete search history.

(56) References Cited

U.S. PATENT DOCUMENTS

| | | | | |
|---|---|---|---|---|
| 2,836,826 | A * | 6/1958 | Geiss | A41D 27/10 2/125 |
| 4,937,883 | A * | 7/1990 | Shirai | A41D 1/04 2/113 |
| 5,349,704 | A * | 9/1994 | Masters | A41D 13/0015 2/243.1 |
| 5,652,967 | A * | 8/1997 | Hsu | A41D 13/0158 2/463 |
| 6,088,831 | A | 7/2000 | Jensen et al. | |
| 8,578,517 | B2 | 11/2013 | Alaniz et al. | |
| 11,369,151 | B2 | 6/2022 | Forell | |
| 11,534,645 | B2 | 12/2022 | Forell | |
| 2006/0085889 | A1 * | 4/2006 | Okajima | A41D 31/18 2/77 |

(Continued)

FOREIGN PATENT DOCUMENTS

JP 2009293145 A * 12/2009 ..... A41D 13/0015

OTHER PUBLICATIONS

Translation of JP 2009293145A (Year: 2009).*

(Continued)

*Primary Examiner* — Sally Haden
*Assistant Examiner* — Grady Alexander Nunnery
(74) *Attorney, Agent, or Firm* — Dinsmore & Shohl LLP

(57) ABSTRACT

A support shirt including a shirt body including a front portion having a top edge and an opposite bottom edge, a pair of sleeves extending outwardly from the front portion, and a restriction panel provided on the front portion between the pair of sleeves and extending from the top edge toward the bottom edge, the restriction panel defined by a pair of restriction seams, wherein the sleeves have a sleeve elasticity and the restriction panel has a restriction elasticity less than the sleeve elasticity.

19 Claims, 7 Drawing Sheets

(56) References Cited

U.S. PATENT DOCUMENTS

| | | | | |
|---|---|---|---|---|
| 2007/0157369 | A1* | 7/2007 | Uchibori | A41D 1/04 2/255 |
| 2014/0201883 | A1* | 7/2014 | Achtymichuk | A41D 27/10 2/69 |
| 2015/0257454 | A1* | 9/2015 | Johnson | A41C 1/02 450/11 |
| 2017/0027237 | A1* | 2/2017 | Yu | A41B 1/18 |
| 2017/0027238 | A1* | 2/2017 | Groth | A41B 3/06 |
| 2017/0232290 | A1 | 8/2017 | Alaniz, III | |
| 2018/0213864 | A1 | 8/2018 | Parker | |
| 2022/0134163 | A1 | 5/2022 | Forell | |

OTHER PUBLICATIONS

International Search Report and Written Opinion issued on Sep. 18, 2024 in related International Patent Application No. PCT/US2024/027453 filed May 2, 2024.

* cited by examiner

SUPPORT SHIRTS INCLUDING A RESTRICTION PANEL

CROSS-REFERENCE TO RELATED APPLICATION

This application claims priority to U.S. Patent Application No. 63/118,108, filed Nov. 25, 2020, for "Support Shirts Including A Restriction Panel," which is hereby incorporated by reference in its entirety including the drawings.

TECHNICAL FIELD

The present specification generally relates to support shirts for supporting a wearer such as while performing a powerlifting exercise and, more specifically, support shirts that restrict the wearer's range of motion during a lifting exercise.

BACKGROUND

Support shirts may be used for supporting a wearer during weightlifting activities. Support shirts can assist in increasing the amount of weight that a wearer can lift by storing energy within the shirt. However, injury can result from flexion of the wearer's arms while bringing a weightlifting bar closer to the wearer's chest. Further, a chest area of traditional support shirts may lift away from the wearer's chest when the wearer's arms are extended, which may be prohibited in powerlifting organizations. Moreover, the elastic material of traditional support shirts stretches unevenly during weightlifting, resulting in a loss of stored energy in the support shirt.

SUMMARY

In one embodiment, a support shirt includes a shirt body including a front portion having a top edge and an opposite bottom edge, a pair of sleeves extending outwardly from the front portion, and a restriction panel provided on the front portion between the pair of sleeves and extending from the top edge toward the bottom edge, wherein the sleeves have a sleeve elasticity and the restriction panel has a restriction elasticity less than the sleeve elasticity.

In another embodiment, a support shirt includes a shirt body including a front portion having a top edge, an opposite bottom edge, and a pair of circular seams defining a pair of sleeve openings, a collar provided at the top edge of the front portion of the shirt body, a pair of sleeves extending outwardly from the front portion, the pair of sleeves being fixed to the front portion at the pair of sleeve openings, and a restriction panel provided on the front portion between the pair of sleeves and extending from the top edge toward the bottom edge, the restriction panel being defined by a pair of restriction seams, the pair of restriction seams being parallel to one another and extending from the top edge toward the bottom edge, the pair of restriction seams contacting the pair of circular seams. The pair of sleeves has a sleeve elasticity, the restriction panel has a restriction elasticity less than the sleeve elasticity, and the collar has a collar elasticity less than the sleeve elasticity.

In yet another embodiment, a method of manufacturing a support shirt, the method including forming a shirt body, coupling a restriction panel to the shirt body, and coupling a pair of sleeves to the shirt body on opposite sides of the restriction panel, wherein the pair of sleeves has a sleeve elasticity and the restriction panel has a restriction elasticity less than the sleeve elasticity. Forming the shirt body includes coupling a first panel to a second panel, and coupling the second panel to a third panel.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments described herein are directed to support shirts that include a pair of sleeves configured to store energy upon movement of a wearer's arms from a raised position to a lowered position in a bench press activity, and a restriction panel configured to restrict the wearer's arms from moving beyond the lowered position. The lowered position is a position that prevents a weightlifting bar from lowering beyond a point at which the weightlifting bar contacts a chest of the wearer when the support shirt is worn and while performing a lifting exercise such as, for example, a bench pressing exercise. It should be appreciated that the support shirts disclosed herein are equally applicable in other exercises such as, for example, a powerlifting activity.

The support shirts described herein generally include a shirt body, a pair of sleeves, and a restriction panel. The shirt body includes a top edge, a front portion, and an opposite back portion, the front portion having a top edge and an opposite bottom edge. The pair of sleeves extend outwardly from the front portion, and the restriction panel is provided on the front portion between the pair of sleeves. The sleeves are formed of a sleeve material and have a sleeve elasticity, and the restriction panel is formed of a restriction material and has a restriction elasticity less than the sleeve elasticity. Various embodiments of the support shirts will be described in more detail herein.

As used herein, "elasticity" refers to the ability of a material to stretch. A material having a higher, or greater, elasticity than another material stretches a further distance than the other material under the same application of force. A material having a lower, or lesser, elasticity than another material stretches a lesser distance than the other material under the same application of force. Specifically, elasticity may be measured in pounds per square inch (psi) or gigapascals (GPa) using Young's modulus or any other suitable unit for measuring elasticity and strain. For example, when a first material has a greater elasticity than a second material, the first material has a Young's modulus lower or less than the Young's modulus of the second material, e.g., the first material has a lower psi and GPa measurement than the second material. Alternatively, when the first material has a lower elasticity than the second material, the first material has a Young's modulus higher or greater than the Young's modulus of the second material, e.g., the first material has a higher psi and GPa measurement than the second material. As referred to herein, the elasticity and Young's modulus of a material is measured by an overall elasticity of the material, rather than any particular portion or region of the material. As such, the elasticity and Young's modulus of the material is generally the same regardless of a direction in which tension is applied on the material.

Figure 1:
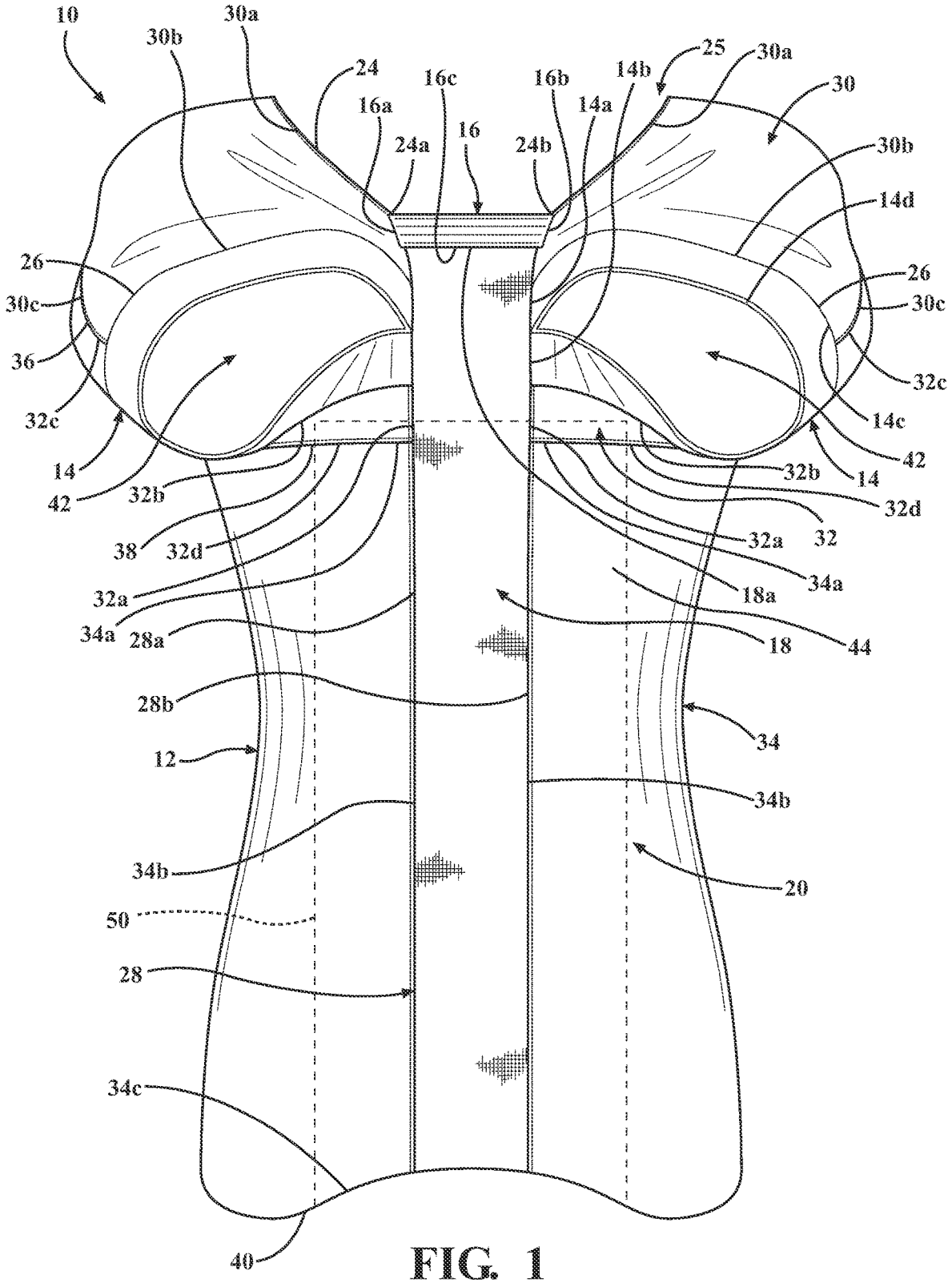
FIG. 1 schematically depicts a front view of an illustrative support shirt, according to one or more embodiments shown and described herein.
Figure 2:
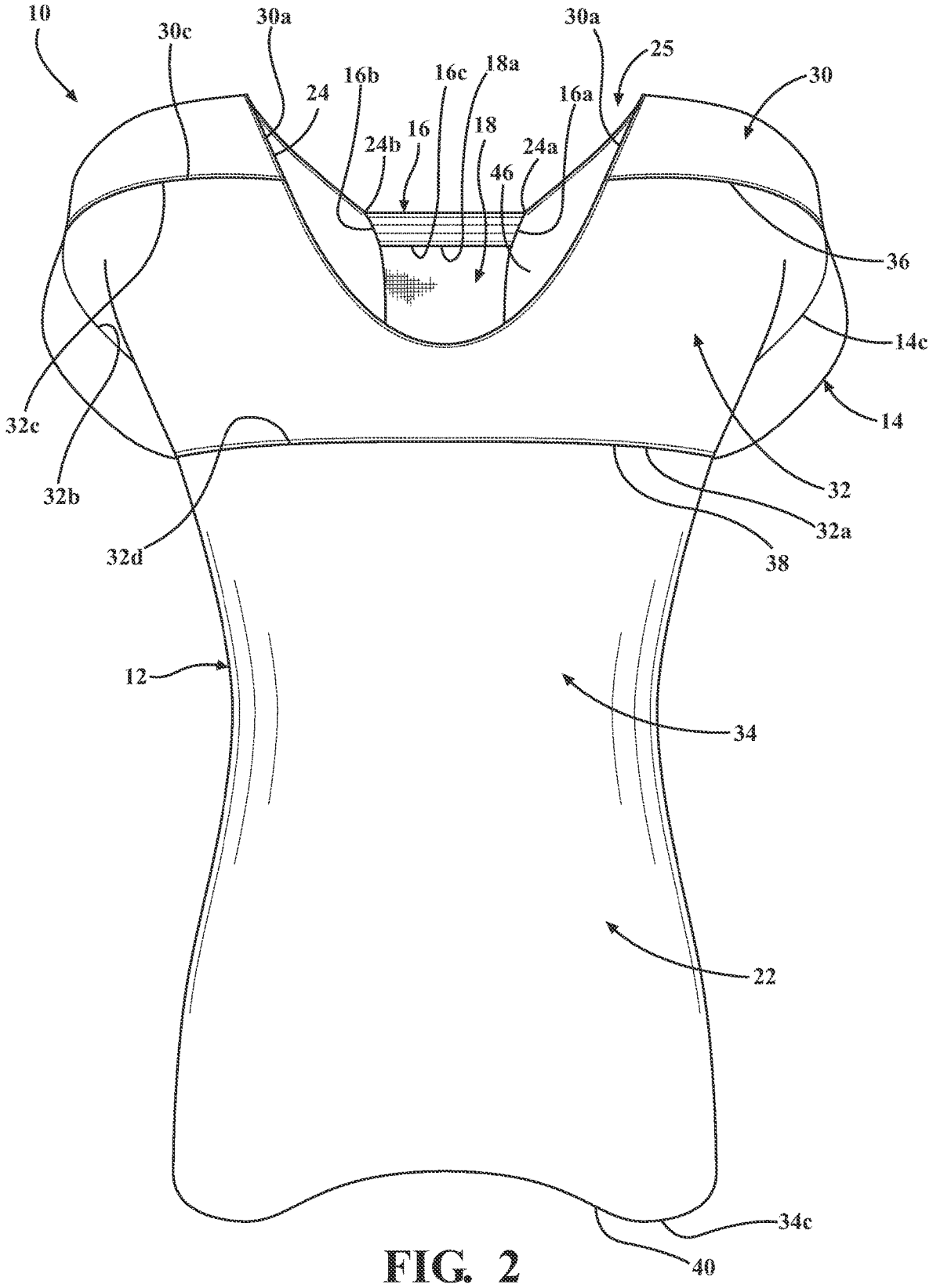
FIG. 2 schematically depicts a rear view of the support shirt of FIG. 1, according to one or more embodiments shown and described herein.
Figure 4:
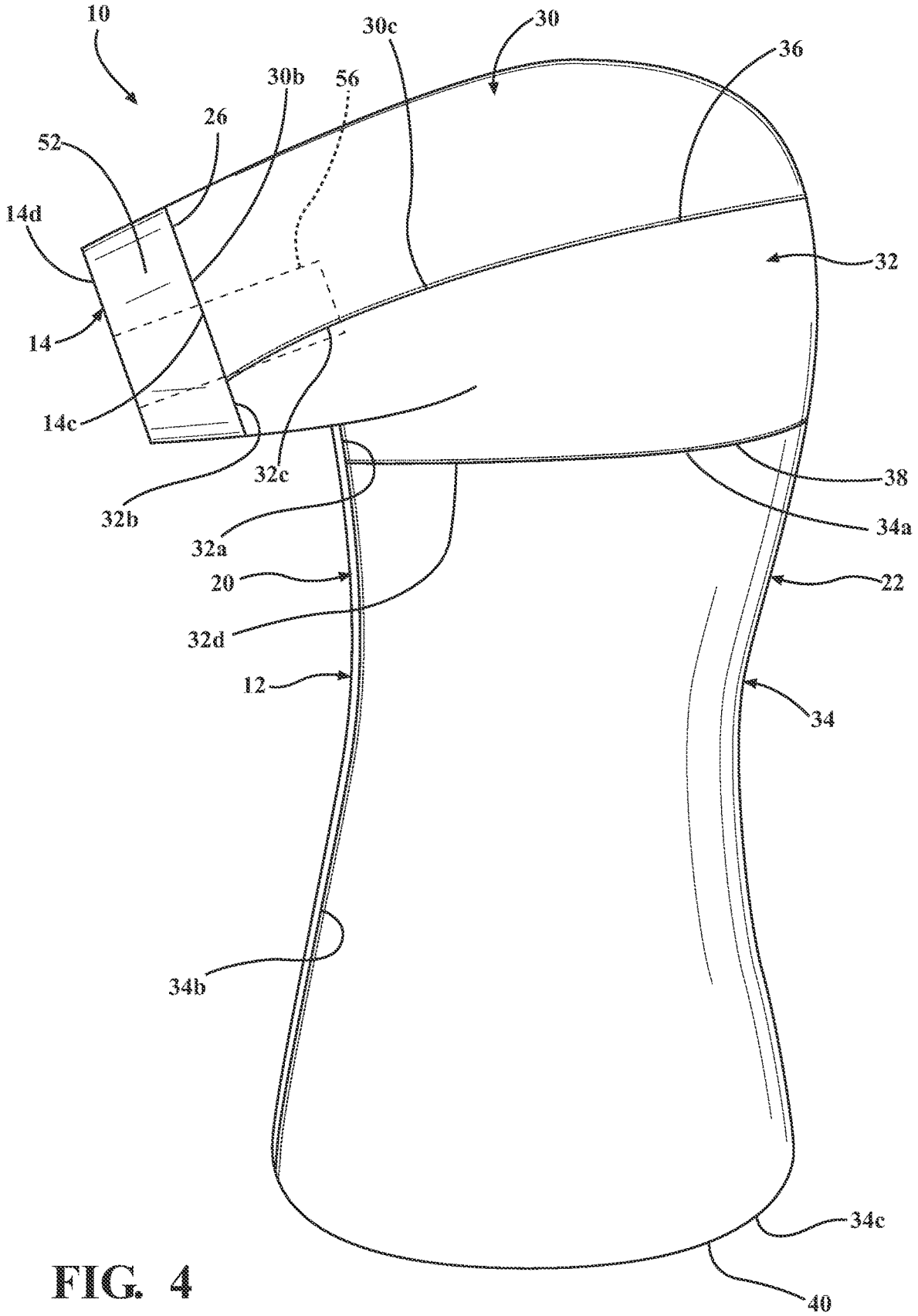
FIG. 4 schematically depicts a first side view of the support shirt of FIG. 1, according to one or more embodiments shown and described herein.
Figure 5:
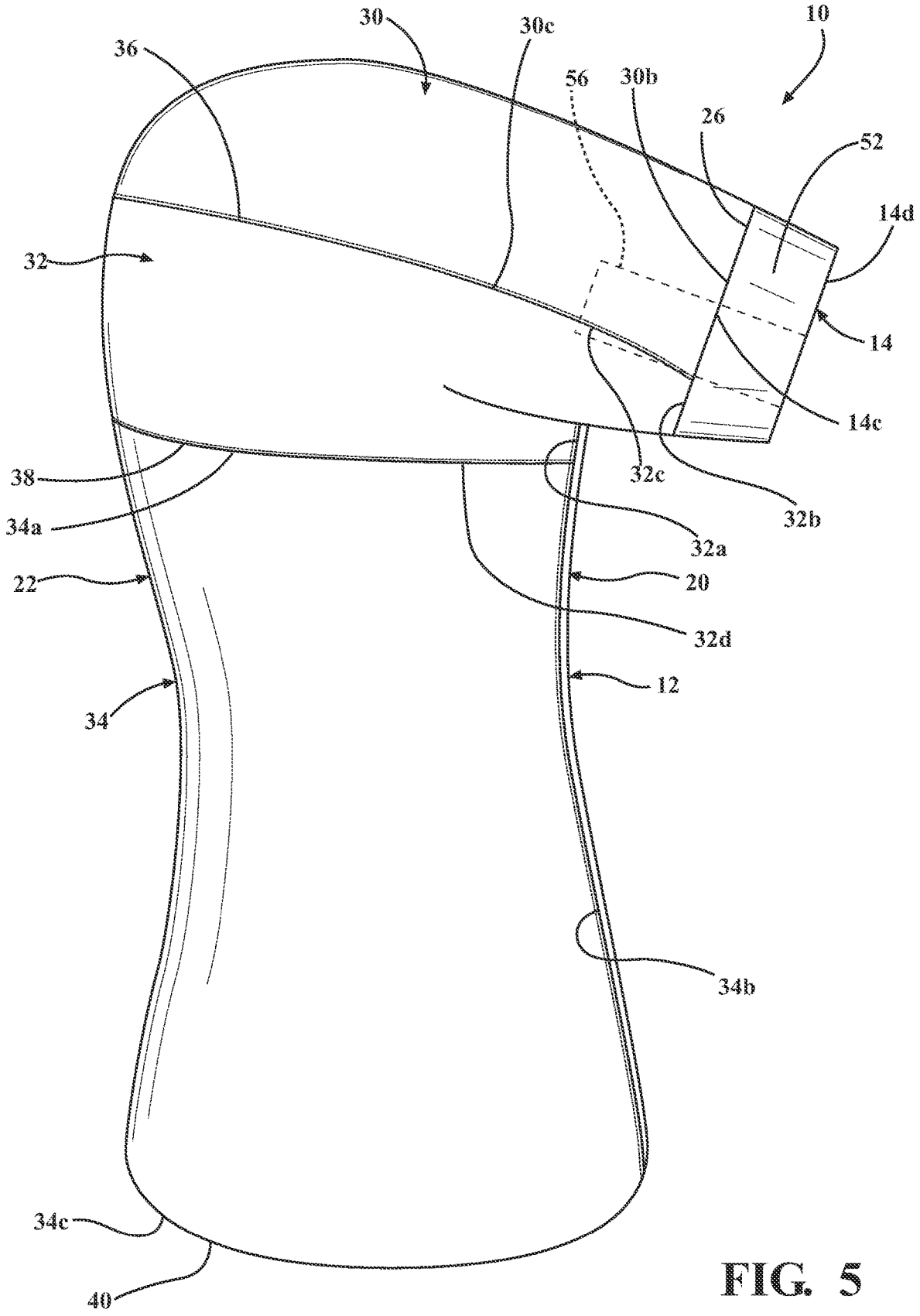
FIG. 5 schematically depicts an opposite second side view of the support shirt of FIG. 1, according to one or more embodiments shown and described herein.
Figure 6:
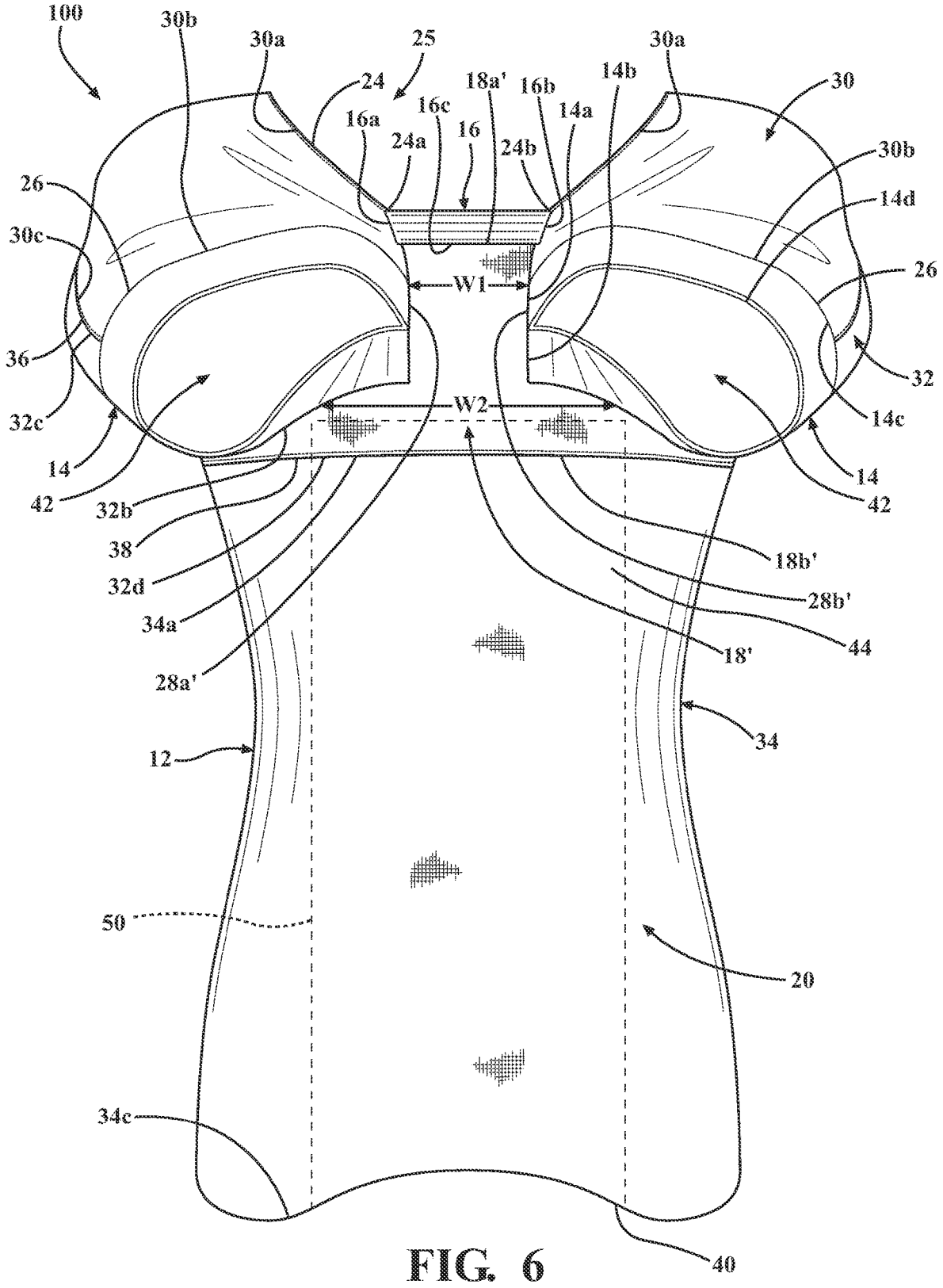
FIG. 6 schematically depicts a front view of another illustrative support shirt, according to one or more embodiments shown and described herein.

Referring now to FIGS. 1-5, an embodiment of a support shirt 10 includes a shirt body 12, a pair of sleeves 14, a collar 16, a restriction panel 18, and a protective pad 50 (shown in FIG. 6 in phantom). The support shirt 10 is configured to be worn over a wearer's arms and torso, where the wearer's arms are defined by a portion between the wearer's shoulders and elbows, and the wearer's torso is defined by the wearer's chest. The shirt body 12 may include a front portion 20 and an opposite back portion 22 defined by a coronal plane of the wearer, where the front portion 20 is positioned on the anterior side of the coronal plane and the back portion 22 is positioned on the posterior side of the coronal plane. The shirt body 12 may include an outer surface 44 and an opposite inner surface 46 (FIG. 2). The back portion 22 may be coupled to the front portion 20 to encircle the torso of the wearer. In embodiments, the shirt body 12 includes a top edge 24, an opposite bottom edge 40, a first panel 30, a second panel 32, and a third panel 34. The second panel 32 is positioned between the first panel 30 and the third panel 34. In embodiments, the first panel 30, the second panel 32, and the third panel 34 are fixed to one another at adjacent edges by stitching, welding, or the like. In other embodiments, the first panel 30, the second panel 32, and the third panel 34 form a one-piece construction. The top edge 24 of the shirt body 12 at least partially defines a neck hole 25.

The front portion 20 includes a pair of sleeve openings 42 defined by a pair of circular seams 26, which extend along the first panel 30 and the second panel 32. The front portion 20 also includes a pair of restriction seams 28*a*, 28*b*, hereinafter referred to as restriction seams 28, that couple the restriction panel 18 to the remainder of the front portion 20 including the first panel 30, the second panel 32, the third panel 34, the collar 16, and the sleeves 14. In embodiments, the first panel 30 is fixed to the second panel 32 along a first seam 36, and the second panel 32 is fixed to the third panel 34 along a second seam 38. The bottom edge 40 is positioned on an edge of the third panel 34 opposite the second seam 38.

As shown in FIG. 6, the protective pad 50 may be positioned at the front portion 20 of the shirt body 12. The protective pad 50 may be positioned between the outer surface 44 and the inner surface 46 (FIG. 2) of the front portion 20 of the shirt body 12. The protective pad 50 may be positioned within the shirt body 12 such that the protective pad 50 is positioned over a torso of a wearer, such as the chest or abdominals. The protective pad 50 may extend from the bottom edge 40 toward the top edge 24. The protective pad 50 may be spaced apart from the top edge 24 of the shirt body 12. The protective pad 50 may have a width that is greater than a width of the restriction panel 18. The protective pad 50 may be provided between layers of fabric of the front portion 20 of the shirt body 12. In embodiments, the protective pad 50 may be provided on either of the outer surface 44 or the inner surface 46 of the front portion 20. The protective pad 50 may be formed of a hard material, such as wood, hard rubber, metal, and the like. The protective pad 50 is configured to protect a wearer in a case when a barbell, or other equipment, drops on the wearer. In use, the protective pad 50 distributes the weight from the barbell or other equipment across the front of the wearer when the barbell or other equipment is dropped on the wearer. The protective pad 50 may include an elastic material, such as neoprene, rubber, and the like, and may include springs. The protective pad 50 may assist the wearer in increasing an amount of weight that the wearer may lift. Specifically, the protective pad 50 may compress when a barbell is brought toward the wearer. As such, the protective pad 50 may act like a spring, providing a biasing force away from the wearer when compressed.

As shown in FIG. 2, the first seam 36 extends generally along a transverse plane from the pair of sleeves 14, specifically the sleeve openings 42 to the neck hole 25 at the top edge 24 of the shirt body 12. In some embodiments, the neck hole 25 is formed at least partially in the first panel 30 and the second panel 32. In some embodiments, the neck hole 25 is formed at least partially in the first panel 30, the second panel 32, and the third panel 34. In some embodiments, the neck hole 25 is formed only in the first panel 30.

Referring again to FIGS. 1-5, the first panel 30 includes a pair of first edges 30*a* extending from the pair of circular seams 26 along the top edge 24 to the first seam 36, a pair of second edges 30*b* extending from the pair of restriction seams 28 along the pair of circular seams 26 to the first seam 36, and a pair of third edges 30*c* extending from the pair of circular seams 26 along the first seam 36 to the top edge 24. The second panel 32 includes a pair of first edges 32*a* extending from the second seam 38 along the restriction seams 28 to the pair of circular seams 26, a pair of second edges 32*b* extending from the restriction seams 28 along the pair of circular seams 26 to the first seam 36, a pair of third edges 32*c* extending from the pair of circular seams 26 along the first seam 36 to the top edge 24, and a fourth edge 32*d* extending between the restriction seams 28 along the second seam 38. The third panel 34 includes a first edge 34*a* extending between the pair of restriction seams 28 along the second seam 38, a pair of second edges 34*b* extending from the second seam 38 along the pair of restriction seams 28 to the bottom edge 40, and a third edge 34*c* extending between the pair of restriction seams 28 along the bottom edge 40.

The pair of third edges 30*c* of the first panel 30 is fixed to the pair of third edges 32*c* of the second panel 32 along the first seam 36. The fourth edge 32*d* of the second panel 32 is fixed to the first edge 34*a* of the third panel 34 along the second seam 38. The pair of sleeves 14 is fixed to the pair of second edges 30*b* of the first panel 30 and the pair of second edges 32*b* of the second panel 32 along the pair of circular seams 26. The restriction panel 18 is fixed to the pair of first edges 30*a* of the first panel 30, the pair of first edges 32*a* of the second panel 32, and the pair of second edges 34*b* of the third panel 34 along the restriction seams 28. The first panel 30, the second panel 32, and the third panel 34 are formed from a body material configured to allow a wearer to easily place the support shirt 10 over the wearer's torso. The body material has a body elasticity.

In embodiments, the body material is formed of a knee wrap material. In some embodiments, the body material is a woven or non-woven fabric material that includes elastic strands extending therethrough. In some embodiments, the fabric is formed of at least one of nylon, cotton, and polyester.

Referring again to FIG. 2, the top edge 24 has a first end 24*a* and a second end 24*b* opposite the first end 24*a*. The first end 24*a* is fixed to the restriction seam 28*a*, and the second end 24*b* is fixed to the restriction seam 28*b*. As such, the top edge 24 defines the neck hole 25 for a wearer's head and neck to extend through the support shirt 10 when worn.

In some embodiments, the first panel 30 may continuously extend along both the front portion 20 and the back portion 22 as a one-piece member to encircle the torso of the wearer when worn. In some embodiments, the second panel 32 may continuously extend along both the front portion 20 and the back portion 22 as a one-piece member to encircle the torso of the wearer when worn. In some embodiments, the third panel 34 may continuously extend along both the front portion 20 and the back portion 22 as a one-piece member to encircle the torso of the wearer when worn. In other embodiments, one or more of the first panel 30, the second panel 32, and the third panel 34 may be formed from a plurality of members fixed to one another, such as by stitching, welding, or the like.

In embodiments, the first seam 36 is eliminated such that the first panel 30 and the second panel 32 are formed as a one-piece, monolithic structure. In embodiments, the second seam 38 is eliminated such that the second panel 32 and the third panel 34 are formed as a one-piece, monolithic structure. In embodiments, the first seam 36 and the second seam 38 are both eliminated such that the first panel 30, the second panel 32, and the third panel 34 are formed as a one-piece, monolithic structure.

Figure 3:
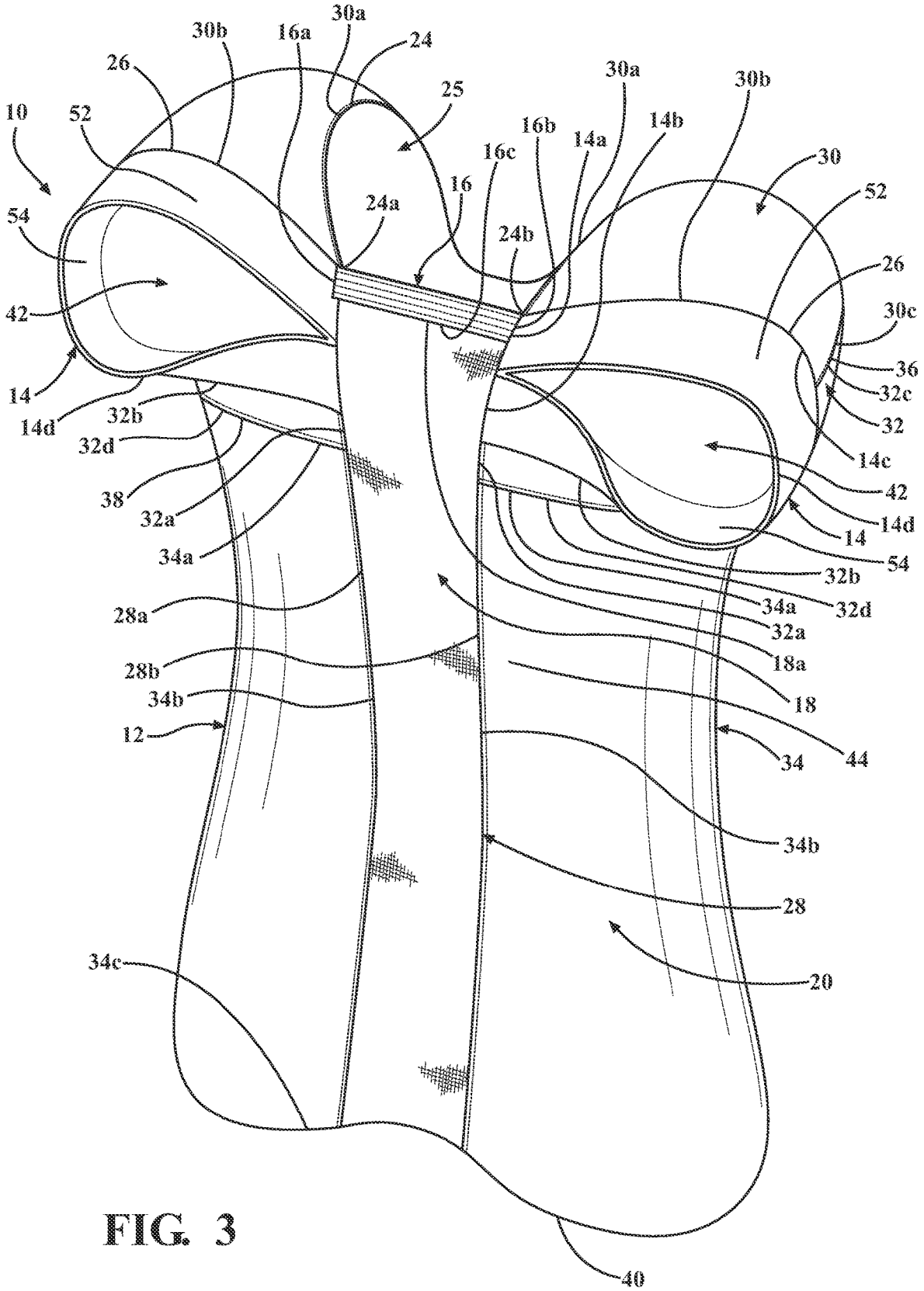
FIG. 3 schematically depicts a perspective view of the support shirt of FIG. 1, according to one or more embodiments shown and described herein.

Referring now to FIG. 3, each of the pair of sleeves 14 define a corresponding sleeve opening 42 through which an arm of the wearer extends. The pair of sleeves 14 each include a first edge 14*a* and a second edge 14*b*. The first edge 14*a* and second edge 14*b* of each sleeve 14 are fixed to the pair of restriction seams 28. Specifically, the first edge 14*a* is fixed to the pair of restriction seams 28 above the second edge 14*b*. The pair of sleeves 14 each includes a third edge 14*c* which is fixed to and extends along the pair of circular seams 26, and a fourth edge 14*d* opposite the third edge 14*c*.

As shown in FIGS. 4 and 5, the sleeves 14 extend outwardly from the front portion 20. In some embodiments, the pair of sleeves 14 extends from the front portion 20 in a direction perpendicular to the coronal plane of an individual wearing the support shirt 10. Here, the pair of sleeves 14 extend parallel to one another. In other embodiments, the pair of sleeves 14 extend from the front portion 20 in a direction non-perpendicular (e.g. obliquely) to the coronal plane of an individual wearing the support shirt 10. For example, the pair of sleeves 14 may extend at an acute angle upwards in a direction opposite the second seam 38. In further embodiments, the pair of sleeves 14 may extend at an acute angle downwards in a direction toward the second seam 38.

The sleeves 14 are formed from a sleeve material that provides support to the arms of the wearer during use. In embodiments, the sleeve material has a sleeve elasticity greater than the body elasticity.

In embodiments, the sleeve material is formed of a knee wrap material. In some embodiments, the sleeve material is a woven or non-woven fabric material that includes elastic strands extending therethrough. In some embodiments, the fabric is formed of at least one of nylon, cotton, and polyester. In embodiments, the sleeve material is the same as the body material, where the sleeve material is thicker than the body material. In other embodiments, the sleeve material is different than the body material, where the sleeve material has an elasticity less than the body material. Specifically, the sleeve material may have a Young's modulus that is greater than the Young's modulus of the body material. In other embodiments, the sleeve material has a sleeve elasticity equal to the body elasticity.

The pair of sleeves 14 may each include a compression member 56 (shown in FIGS. 4 and 5 in phantom). The compression member 56 may be provided between an outer surface 52 and an inner surface 54 (FIG. 1) of the respective sleeve 14, such that the compression member 56 is provided between two layers of fabric. In embodiments, the compression member 56 may be provided on either of the outer surface 52 or the inner surface 54 of the sleeve 14. The compression member 56 may extend along a length of each of the sleeves 14. The compression member 56 may extend from the fourth edge 14*d* of the sleeve 14 to the third edge 14*c*. In embodiments, the compression member 56 may extend past the third edge 14*c* into the shirt body 12. The compression member 56 may be substantially rectangular in shape. However, the compression member 56 may be any shape, such as triangular, pentagonal, or the like. The compression member 56 may be positioned within each sleeve 14 such that the compression member 56 extends along a portion of an arm of the wearer, such as a tricep of the wearer. The compression members 56 may be provided on outer sides of the support shirt 10, such as opposite the restriction panel 18, so that the compression members 56 extend along the triceps of the wearer when worn. The compression member 56 may have an elasticity that is less than the sleeve elasticity.

The compression member 56 may be formed of a compressible material, such as neoprene, rubber, cotton, polyester, and the like, and may include inner springs, gel, an air pocket, a fluid pocket, and the like. The compression member 56 may compress when the sleeves 14 bend, such as during the descent of a pressing movement. The compression of the compression member 56 prevents the sleeves 14 from bunching around the arms of a wearer, thereby preventing restriction of blood flow to the arms of the wearer. The compression member 56 may store energy when compressed, such that the compression member 56 assists the wearer in extending the wearer's arms.

Referring again to FIG. 1, the collar 16 includes a first edge 16*a*, a second edge 16*b*, and a third edge 16*c*. The collar 16 is located at the top edge 24 of the front portion 20 of the shirt body 12. The first edge 16*a* of the collar 16 is fixed to the first end 24*a* of the top edge 24 of the front portion 20, and the second edge 16*b* of the collar 16 is fixed to the second end 24*b* of the top edge 24 of the front portion 20. In embodiments, the collar 16 may be made from at least one of a double knit polyester, polyester, nylon, canvas, denim, or synthetic fiber, for example, Kevlar®. The collar 16 has a collar elasticity that is less than the body elasticity of the shirt body 12. Specifically, the collar 16 may have a Young's modulus that is greater than the Young's modulus of the shirt body 12. In some embodiments, the collar elasticity is less than the sleeve elasticity. Specifically, the collar 16 may have a Young's modulus that is greater than the Young's modulus of the pair of sleeves 14. In other embodiments, the collar elasticity is greater than or equal to the sleeve elasticity.

As shown in FIGS. 1 and 3, the restriction panel 18 is provided between and fixed to the pair of restriction seams 28, which extends along the front portion 20 of the shirt body 12. In embodiments, the restriction panel 18 overlies material forming the front portion 20 of the shirt body 12. In other embodiments, the material of the shirt body 12 does not extend across the front portion 20 between the restriction seams 28, where the restriction panel 18 is fixed between the restriction seams 28. A top edge 18*a* of the restriction panel 18 is fixed to the third edge 16*c* of the collar 16. As noted above, the restriction panel 18 is fabricated from a restriction material having a restriction elasticity. The restriction material may include at least one of a double knit polyester, denim, and nylon. However, other materials are contemplated and included within the scope of the present disclosure. In some embodiments, the restriction panel 18 extends along the entire front portion 20 of the shirt body 12 in a vertical direction, such as from the collar 16 at the top edge 24 of the front portion 20 of the shirt body 12, to the bottom edge 40 of the front portion 20 of the shirt body 12. In other embodiments, the restriction panel 18 extends in a vertical direction less than an entire length of the front portion 20 such that, for example, the restriction panel 18 may terminate at or near the first edge 34*a* of the third panel 34, as discussed in more detail herein. In some embodiments, the restriction elasticity of the restriction panel 18 is less than the body elasticity and the sleeve elasticity. In other words, the restriction panel 18 has a greater Young's modulus than the shirt body 12 and the pair of sleeves 14. In other embodiments, the restriction elasticity is greater than or equal to the sleeve elasticity. In other words, the restriction panel 18 has a Young's modulus that is equal to or less than the Young's modulus of the pair of sleeves 14. In some embodiments, the restriction elasticity is less than the collar elasticity. In other embodiments, the restriction elasticity is greater than or equal to the collar elasticity of the collar 16. In other words, the restriction panel 18 is at least the same or more elastic than the collar 16.

In embodiments, the second panel 32 and the third panel 34 may be discontinuous members such that the second panel 32 and the third panel 34 do not extend across the entire back portion 22 of the shirt body 12 between the pair of sleeves 14. As such, the back portion 22 of the shirt body 12 may expose the back of the torso of the wearer when the support shirt 10 is worn. In this embodiment, the opposite sides of the back portion 22 may be secured to one another by fasteners extending from opposite sides of one or more of the second panel 32 and the third panel 34. The fasteners may include at least one of hook and loop fasteners, straps, ties, buttons, magnets, or any other well-known known fastener. As a non-limiting example, the fasteners may be one or more straps extending from one or more sides of the second panel 32 and/or the third panel 34 to wrap around the torso of the wearer to secure opposite sides of the second panel 32 and/or the third panel 34 to one another.

As discussed herein, the support shirt 10 provides support to the wearer when the wearer's arms are in a raised or extended position and a lowered or retracted position. In use, the wearer's arms are fully extended outwards from the wearer's torso when in the extended position. When in the retracted position, the wearer's elbows are positioned closer to the front portion 20 than in the extended position, with the wearer's elbows bent and positioned in substantially a same plane as the torso.

When the support shirt 10 is worn by the wearer, the sleeves 14 provide support to the arms, biasing the arms toward the extended position. When the arms are moved from the extended position to the retracted position, the sleeves 14 are stretched by the bending of the arms, thereby increasing a biasing force provided by the sleeve elasticity of the sleeve material. Additionally, during movement of the arms from the extended position to the retracted position, the restriction panel 18 inhibits the arms of the wearer from extending beyond the retracted position. Specifically, as the restriction panel 18 is formed of the restriction material that has the restriction elasticity that is less than the sleeve elasticity, the restriction panel 18 restricts the stretching of the sleeves 14 beyond the retracted position. The inhibiting of the movement of the arms of the wearer from extending beyond the retracted position prevents the arms of the wearer from extending beyond a point at which the weightlifting bar contacts the chest of the wearer. Specifically, upon further movement of the arms beyond the retracted position, the amount of downward movement of the weightlifting bar and consequently an amount of distance the weightlifting bar must be moved to reach the extended position is reduced.

The compression member 56 in each of the sleeves 14 compresses when the arms are in the retracted position, thereby preventing bunching of the sleeves 14. Additionally, the compression member 56 stores energy to assist the wearer in moving the arms from the retracted position to the extended position. Further, when in the retracted position, the weightlifting bar may be resting on the protective pad 50. The protective pad 50 distributes the weight of the weightlifting bar across the torso of the wearer. Additionally, the protective pad 50 may be compressed by the weightlifting bar, thereby storing energy in a manner similar to the compression members 56 to assist the wearer when moving from the retracted position to the extended position.

When the wearer's arms are in the retracted position, a concentration of stress is located at an upper part of the front portion 20 near the collar 16. In some embodiments, the collar 16 may also inhibit movement of the sleeves 14 beyond the lowered position due to the collar 16 being formed of the collar material that has the collar elasticity that is less than the sleeve elasticity and/or the restriction elasticity, such that the collar 16 inhibits the support shirt 10 from tearing at the stress concentration area when under stress from the arms in the retracted position. In some embodiments, the restriction panel 18 cooperates with the collar 16 to prevent tearing at the stress concentration area when under stress from the arms in the retracted position. In some embodiments, the restriction panel 18 and the collar 16 are formed as a one-piece, monolithic structure.

When the wearer's arms extend from the retracted position toward the extended position, the stretched material (e.g. the concentration of stress) provides a biasing force on the wearer's arms, biasing the wearer's arms toward the extended position. The biasing force assists the wearer in bench pressing a greater amount of weight. The protective pad 50 and compression members 56 additionally provide a biasing force on the wearer's arms to assist the wearer in moving toward the extend position.

Referring now to FIG. 6, in another embodiment, a support shirt 100 is shown. It should be appreciated that the support shirt 100 is similar to the support shirt 10 discussed above. Therefore, like reference numerals will be used to discuss like parts. As such, the support shirt 100 includes the shirt body 12, the pair of sleeves 14, the collar 16, and a restriction panel 18'. It should be appreciated that the restriction panel 18' differs from the restriction panel 18 discussed herein such that the restriction panel 18' does not extend along the entire length of the front portion 20 of the shirt body 12 to the bottom edge 40 thereof. The restriction panel 18' is provided between the pair of circular seams 26 and defined by a pair of restriction seams 28*a*', 28*b*' fixed to the pair of circular seams 26. The restriction panel 18' includes a top edge 18*a*' and a bottom edge 18*b*', where the top edge 18*a*' is fixed to the third edge 16*c* of the collar 16. The restriction panel 18' is fabricated from at least one of, for example, a double knit polyester, denim, and nylon. In some embodiments, the restriction panel 18' has a restriction elasticity less than the sleeve elasticity of the sleeves 14. In other embodiments, the restriction panel 18' has a restriction elasticity greater than or equal to the sleeve elasticity of the sleeves 14. In embodiments, the restriction panel 18' has a first width W1 at or near the top edge 18*a*' extending between the pair of restriction seams 28*a*', 28*b*', and a second width W2 at or near the bottom edge 18*b*' of the restriction panel 18' extending between the pair of restriction seams 28*a*', 28*b*'. In embodiments, the first width W1 is less than the second width W2. In embodiments, the second width W2 of the restriction panel 18' is twice as long as the first width W2 of the restriction panel 18'.

In some embodiments, the sleeve material extends between the sleeve openings 42 defined by the circular seams 26, where the restriction panel 18' overlays the sleeve material. Specifically, a portion of the front portion 20 disposed between the openings of the sleeves 14, through which the arms of the wearer extend, is formed of the sleeve material having the sleeve elasticity. As the restriction panel 18' overlays the portion of the front portion 20 disposed between the sleeve openings 42 of the sleeves 14, the restriction panel 18' inhibits the movement of the sleeves 14 and the arms of the wearer beyond the retracted position. In some embodiments, the portion of the front portion 20 disposed between the sleeve openings 42 of the sleeves 14 is formed of the restriction panel 18' without the sleeve material.

Figure 7:
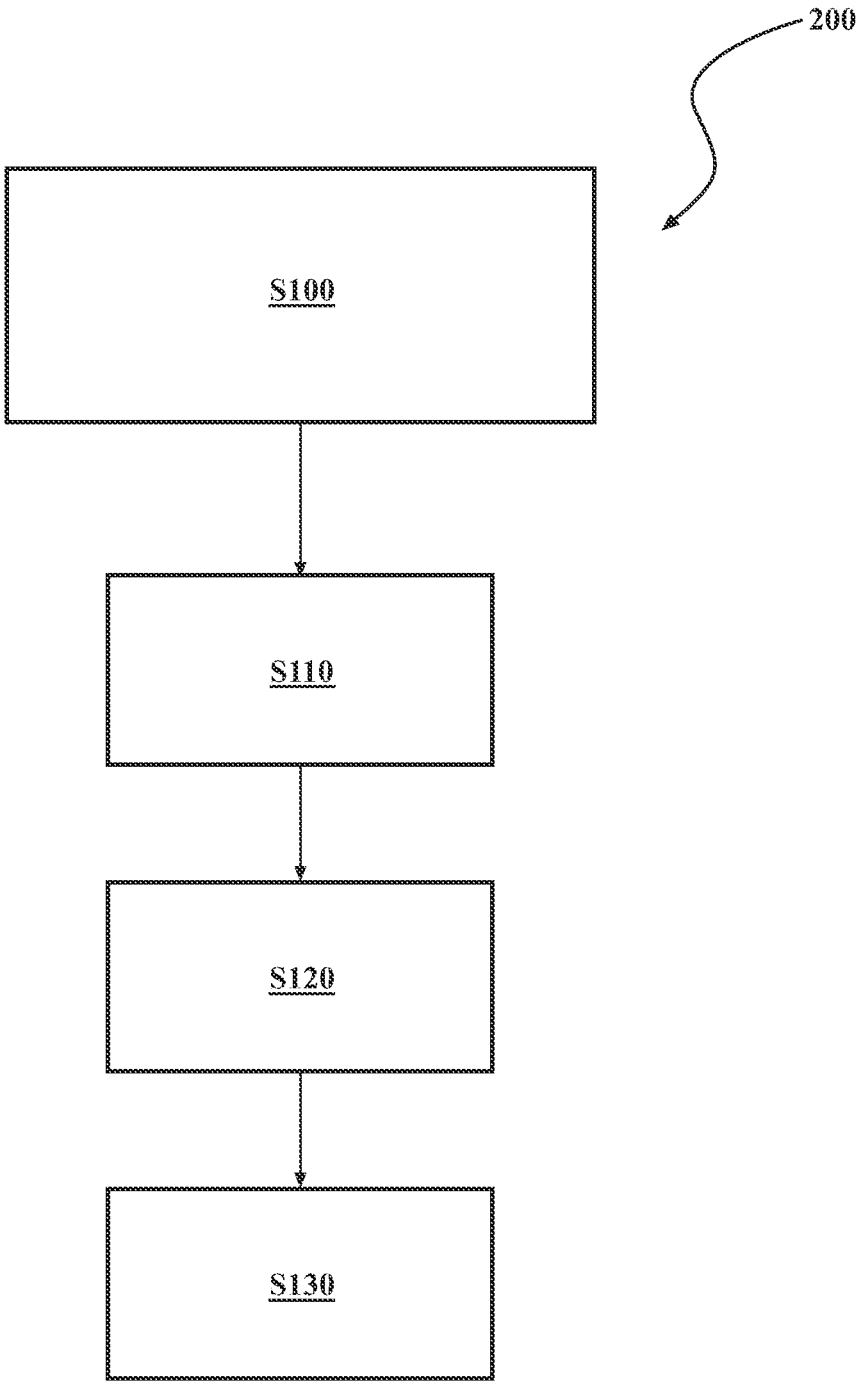
FIG. 7 schematically depicts a flowchart of a method for manufacturing the support shirt, according to one or more embodiments shown and described herein.

Referring now to FIG. 7, a method 200 for manufacturing a support shirt is depicted. The method 200 for manufacturing a support shirt may be directed to manufacturing either the support shirt 10 or the support shirt 100. At step S100, the first panel 30 is coupled to the second panel 32. The pair of third edges 30*c* of the first panel 30 are coupled to the pair of third edges 32*c* of the second panel 32 along the first seam 36. At step S110, the second panel 32 is coupled to the third panel 34. Specifically, the fourth edge 32*d* of the second panel 32 is coupled to the first edge 34*a* of the third panel 34 along the second seam 38. At step S120, the restriction panel 18 is coupled to the shirt body 12. The restriction panel 18 may be coupled to the shirt body 12 at the pair of restriction seams 28. At step S130, the pair of sleeves 14 is coupled to the shirt body 12. The pair of sleeves 14 may be coupled to the shirt body 12 at the pair of circular seams 26. The pair of sleeves 14 may be coupled to the first panel 30 of the shirt body 12 at the pair of second edges 30*b*, and coupled to the pair of second edges 32*b* of the second panel 32. At step S140, the collar 16 may be coupled to the shirt body 12 and/or the restriction panel 18. The first edge 16*a* of the collar 16 may be coupled to the first end 24*a* of the top edge 24 of the front portion 20, and the second edge 16*b* of the collar 16 may be coupled to the second end 24*b* of the top edge 24 of the front portion 20. Any of the above components may be coupled together via stitching, welding, or the like. As a non-limiting example, the restriction panel 18 may be coupled to the shirt body 12 by stitching. As another non-limiting example, the pair of sleeves 14 may be coupled to the shirt body 12 by welding.

From the above, it is to be appreciated that defined herein are support shirts including a shirt body, a pair of sleeves, and a restriction panel wherein the sleeves are formed of a sleeve material and have a sleeve elasticity, and the restriction panel is formed of a restriction material and has a restriction elasticity less than the sleeve elasticity. As such, the pair of sleeves are configured to store energy upon movement of a wearer's arms from a raised position to a lowered position, and the restriction panel is configured to restrict the wearer's arms from moving beyond the lowered position.

While particular embodiments have been illustrated and described herein, it should be understood that various other changes and modifications may be made without departing from the scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A support shirt comprising:

a shirt body including a front portion having a top edge and an opposite bottom edge;

a collar provided at the top edge of the front portion of the shirt body, wherein the collar is constructed of a collar material;

a pair of sleeves, each of the pair of sleeves extending outwardly from the front portion to a respective free edge, each of the pair of sleeves constructed of a sleeve material extending from the front portion to the respective free edge; and a restriction panel provided on the front portion between the pair of sleeves and extending from the top edge toward the bottom edge, wherein the sleeve material has a sleeve elasticity, the restriction panel has a restriction elasticity less than the sleeve elasticity, and the collar material has a collar elasticity less than the sleeve elasticity and less than the restriction elasticity, wherein the restriction panel is defined by a pair of restriction edges joined to the front portion, wherein a pair of sleeve openings are defined in the front portion, the pair of sleeves being fixed to the front portion at the pair of sleeve openings by a pair of sleeve opening seams, the pair of restriction edges contacting the pair of sleeve opening seams.

2. The support shirt of claim 1, wherein the restriction elasticity is less than a body elasticity of the shirt body.

3. The support shirt of claim 1, wherein the pair of restriction edges are parallel to one another and extend from the top edge toward the bottom edge.

4. The support shirt of claim 1, wherein the restriction panel has an upper end having a first width and an opposite lower end having a second width greater than the first width.

5. The support shirt of claim 1, wherein the restriction panel has an upper end having a first width and an opposite lower end having a second width equal to the first width.

6. The support shirt of claim 1, wherein the pair of sleeves extends from the front portion in a direction perpendicular to the front portion of the shirt body.

7. The support shirt of claim 1, further comprising a protective pad positioned at the front portion of the shirt body, the protective pad having a width that is greater than a width of the restriction panel.

8. The support shirt of claim 1, wherein the shirt body has a body elasticity and the sleeve elasticity is greater than the body elasticity.

9. The support shirt of claim 1, wherein each of the sleeves comprises:

a compression member extending along a length of the sleeve, the compression member having an elasticity that is less than the sleeve elasticity.

10. The support shirt of claim 1, wherein the restriction panel extends from the top edge to the bottom edge.

11. The support shirt of claim 1, wherein the sleeve material completely encircles a respective one of the pair of sleeve openings.

12. The support shirt of claim 1, wherein the pair of sleeves is constructed entirely of the sleeve material.

13. The support shirt of claim 1, wherein the collar has a first edge and a second edge opposite the first edge, and wherein the collar is affixed to the front portion of the shirt body at the first edge and the second edge.

14. The support shirt of claim 13, wherein the collar has a third edge extending between the first edge and the second edge of the collar, and wherein the collar is affixed to the restriction panel at the third edge.

15. The support shirt of claim 13, wherein the collar terminates at the first edge and the second edge of the collar.

16. The support shirt of claim 14, wherein the restriction panel extends in a downward direction from the third edge of the collar.

17. A support shirt comprising:

a shirt body including a front portion having a top edge, an opposite bottom edge, and a pair of sleeve openings sleeve openings defined in the front portion;

a collar provided at the top edge of the front portion of the shirt body, wherein the collar is constructed of a collar material;

a pair of sleeves, each of the pair of sleeves extending outwardly from the front portion to a respective free edge, the pair of sleeves being fixed to the front portion at the pair of sleeve openings by a pair of sleeve opening seams and each of the pair of sleeves being constructed of a sleeve material extending from the front portion to the respective free edge; and a restriction panel provided on the front portion between the pair of sleeves and extending from the top edge toward the bottom edge, the restriction panel being defined by a pair of restriction edges joined to the front portion, the pair of restriction edges extending from the top edge toward the bottom edge, the pair of restriction edges contacting the pair of sleeve opening seams, wherein the sleeve material has a sleeve elasticity, the restriction panel has a restriction elasticity less than the sleeve elasticity, and the collar material has a collar elasticity less than the sleeve elasticity and less than the restriction elasticity.

18. The support shirt of claim 17, wherein the restriction panel extends from the top edge to the bottom edge.

19. The support shirt of claim 17, wherein the restriction panel has an upper end having a first width and an opposite lower end having a second width greater than the first width.

* * * * *